US007051613B2

(12) United States Patent
Burton et al.

(10) Patent No.: US 7,051,613 B2
(45) **Date of Patent: *May 30, 2006**

(54) ADJUSTABLE PEDAL ASSEMBLY

(75) Inventors: Pat Burton, Ridgetown (CA); Dan O'Neill, Chatham (CA); Rob Soteros, Lasalle (CA); Dave Kelloway, St. Bleuheim (CA)

(73) Assignee: KSR Industrial Corporation, Southfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/447,127

(22) Filed: May 28, 2003

(65) Prior Publication Data

US 2003/0192394 A1 Oct. 16, 2003

Related U.S. Application Data

(63) Continuation of application No. 09/882,981, filed on Jun. 15, 2001, now Pat. No. 6,584,871.

(60) Provisional application No. 60/212,108, filed on Jun. 15, 2000.

(51) Int. Cl.
*G05G 1/14* (2006.01)

(52) U.S. Cl. ..... 74/512; 74/513; 74/560

(58) Field of Classification Search ..... 74/512, 74/513, 514, 522, 560

See application file for complete search history.

(56) References Cited

U.S. PATENT DOCUMENTS

| | | | | |
|---|---|---|---|---|
| 2,860,720 | A | 11/1958 | Huff et al. | |
| 2,906,842 | A | 9/1959 | Brin | |
| 2,908,183 | A | 10/1959 | DeGiovanni | |
| 2,936,867 | A | 5/1960 | Perry | |
| 3,301,088 | A | 1/1967 | White | |
| 3,319,487 | A | 5/1967 | Lystad et al. | |
| 3,338,348 | A | 8/1967 | Roethlisberger et al. | |
| 3,400,607 | A | 9/1968 | Smith | |
| 3,511,109 | A | 5/1970 | Tanaka | |
| 3,643,524 | A * | 2/1972 | Herring | 74/512 |
| 3,691,868 | A | 9/1972 | Smith | |
| 3,754,480 | A | 8/1973 | Bradnar et al. | |
| 3,765,264 | A | 10/1973 | Bruhn, Jr. | |
| 3,798,995 | A | 3/1974 | Schroter | |
| 3,828,625 | A | 8/1974 | Bruhn, Jr. | |
| 3,958,677 | A | 5/1976 | Spanelis | |
| 3,975,972 | A | 8/1976 | Muhleck | |
| 4,497,399 | A | 2/1985 | Kopich | |
| 4,683,977 | A | 8/1987 | Salmon | |

(Continued)

FOREIGN PATENT DOCUMENTS

FR 2 739 947 7/1997

*Primary Examiner*—Vinh T. Luong
(74) *Attorney, Agent, or Firm*—Gifford, Krass, Groh, Sprinkle, Anderson & Citkowski, P.C.

(57) ABSTRACT

An adjustable pedal assembly for a vehicle includes an adjustment bracket adapted for mounting on a vehicle, and the adjustment bracket includes a pair of outwardly extending side portions having a vertically extending arcuate slot. The adjustable pedal assembly also includes a pedal arm pivotally attached to the adjustment bracket using a pivot pin, such that an end of the pivot pin is slidably disposed within the arcuate slot in the adjustment bracket. The adjustable pedal assembly further includes a pedal pad mounted to the pedal arm, and a pedal adjustment mechanism operatively attached to the pedal arm, for adjusting the position of the pedal arm along a predetermined path, such that the pivot pin is slidably positioned in the arcuate slot relative to the predetermined path of the pedal arm to ergonomically position the pedal pad.

9 Claims, 4 Drawing Sheets

U.S. PATENT DOCUMENTS 4,870,871 A 10/1989 Ivan
4,875,385 A * 10/1989 Sitrin ..... 74/512
4,912,997 A 4/1990 Malcolm et al.
4,989,474 A 2/1991 Cicotte et al.
5,010,782 A 4/1991 Asano et al.
5,078,024 A 1/1992 Cicotte et al.
5,086,663 A 2/1992 Asano et al.
5,172,606 A 12/1992 Dzioba et al.
5,351,573 A 10/1994 Cicotte
5,385,068 A 1/1995 White et al.
5,408,899 A 4/1995 Stewart
5,460,061 A * 10/1995 Redding et al. ..... 74/512
5,497,677 A 3/1996 Baumann et al.
5,632,183 A 5/1997 Rixon et al.
5,722,302 A 3/1998 Rixon et al.
5,771,752 A 6/1998 Cicotte
5,819,593 A 10/1998 Rixon et al.
5,996,438 A * 12/1999 Elton ..... 74/512
5,996,439 A 12/1999 Elton et al.
6,019,015 A * 2/2000 Elton ..... 74/513
6,073,515 A 6/2000 Elton et al.
6,151,985 A 11/2000 Garber et al.
6,289,761 B1 * 9/2001 Reynolds et al. ..... 74/512
6,321,617 B1 11/2001 Schwyn
6,367,348 B1 4/2002 Toelke et al.
6,367,349 B1 * 4/2002 Allen et al. ..... 74/512
6,584,871 B1 * 7/2003 Burton et al. ..... 74/512
6,662,677 B1 * 12/2003 Rixon et al. ..... 74/512

* cited by examiner

ADJUSTABLE PEDAL ASSEMBLY

RELATED INVENTION

This application claims priority of U.S. Provisional Patent Application No. 60/212,108 filed Jun. 15, 2000, and U.S. patent application Ser. No. 09/882,981, filed Jun. 15, 2001 and entitled: "Adjustable Pedal Assembly" and is incorporated herein by reference.

FIELD OF INVENTION

This invention relates to pedals, and more particularly to an adjustable pedal assembly for a vehicle.

BACKGROUND OF THE INVENTION

Vehicles, such as motor vehicles, typically contain foot-actuated devices or pedals for controlling various functions of the vehicle. These functions are known to include acceleration, controlled by an accelerator pedal; braking controlled by a brake pedal; and shifting controlled by a clutch pedal. These pedals are positioned in the vehicle so that they are accessible by the driver. However, drivers come in a wide variety of shapes and sizes, and a pedal positioned to accommodate a large driver with a large foot will generally be unreachable by a small driver with a small foot. In the past, the pedals were fixedly positioned to accommodate the majority of drivers, from a functional and ergonomic perspective. The functionality of the pedal relates to the ability of the driver to reach and actuate the pedal. Another functional factor is clearance between pedals. The ergonomics of the pedal relates to factors such as the driver's comfort while actuating the pedal, as measured by foot angle. Another example of an ergonomic factor is foot fatigue from maintaining the foot in a fixed position for a period of time.

More recently, adjustable pedals have been used in vehicles to accommodate a greater number of drivers. The driver can modify the position of the pedal relative to the floor of the vehicle. An example of such an adjustable pedal is disclosed in commonly assigned U.S. Pat. No. 6,151,986 to KSR Industrial Corporation entitled "Adjustable Vehicle Control Pedals," the disclosure of which is incorporated herein by reference. While this type of adjustable pedal works by adjusting the relative position of the pedal along a predetermined arc of travel, after the pedal position has been adjusted, the pedal pad may not be aligned ergonomically with respect to the foot of the operator. Thus, there is a need in the art for an ergonomically beneficial adjustable pedal assembly that adjusts the position of both the pedal and pedal pad.

SUMMARY OF THE INVENTION

Accordingly, the present invention is an adjustable pedal assembly. The adjustable pedal assembly includes an adjustment bracket adapted for mounting on a vehicle, and the adjustment bracket includes a pair of outwardly extending side portions having a vertically extending arcuate slot. The adjustable pedal assembly also includes a pedal arm pivotally attached to the adjustment bracket using a pivot pin, such that an end of the pivot pin is slidably disposed within the arcuate slot in the adjustment bracket. The adjustable pedal assembly further includes a pedal pad mounted to the pedal arm, and a pedal adjustment mechanism operatively attached to the pedal arm, for adjusting the position of the pedal arm along a predetermined path, such that the pivot pin is slidably positioned in the arcuate slot relative to the predetermined path of the pedal arm to ergonomically position the pedal pad.

One advantage of the present invention is that an adjustable pedal assembly is provided that is ergonomically positioned with respect to the foot of the driver. Another advantage of the present invention is that an adjustable pedal assembly is provided whereby the angle of the pedal pad with respect to the floor of the vehicle is automatically aligned as the position of the pedal assembly is adjusted. A further advantage of the present invention is that an adjustable pedal assembly is provided that is more comfortable for the driver while operating the vehicle. Still a further advantage of the present invention is that an adjustable pedal assembly is provided that ergonomically positions the pedal pad to improve the feel of the pedal assembly by the driver.

Other features and advantages of the present invention will be readily understood as the same becomes better understood after reading the subsequent description when considered in connection with the accompanying drawings.

DESCRIPTION OF THE PREFERRED EMBODIMENTS

Vehicles, including a motor vehicle (not shown) utilize foot-actuated devices, referred to as pedals, to control a particular function of the vehicle, such as accelerating, braking and shifting. These pedals are referred to in the art as an accelerator pedal, brake pedal and clutch pedal. The pedals are aligned in a predetermined manner relative to each other, and fixed portions of the vehicle, including the vehicle dash panel, floor, seat and instrument panel. The pedal assembly travels in a predetermined path, which in the past was an arc. Thus, to increase the height of the pedal pad (to be described) with respect to the floor, the pedal pad moves rearward along an arc, or into the vehicle. An adjustable pedal assembly includes a pedal pad disposed on an arm. The arm is supported by a bracket, and the bracket is mounted to a portion of the vehicle. The adjustable pedal assembly also includes an actuating mechanism for controlling the position of the pedal pad.

Figure 1:
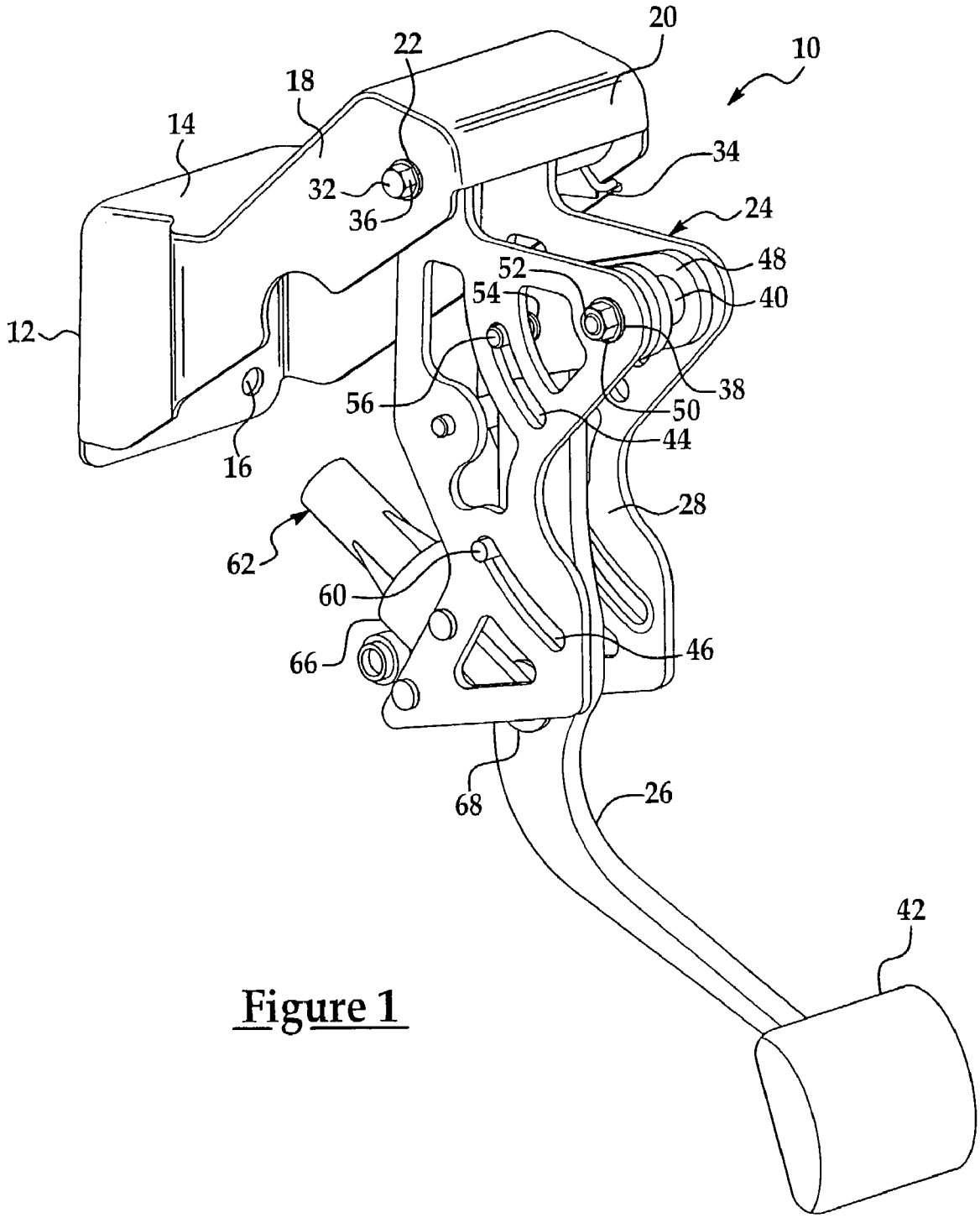
FIG. 1 is a perspective view of an adjustable pedal assembly for braking, according to the present invention.
Figure 2:
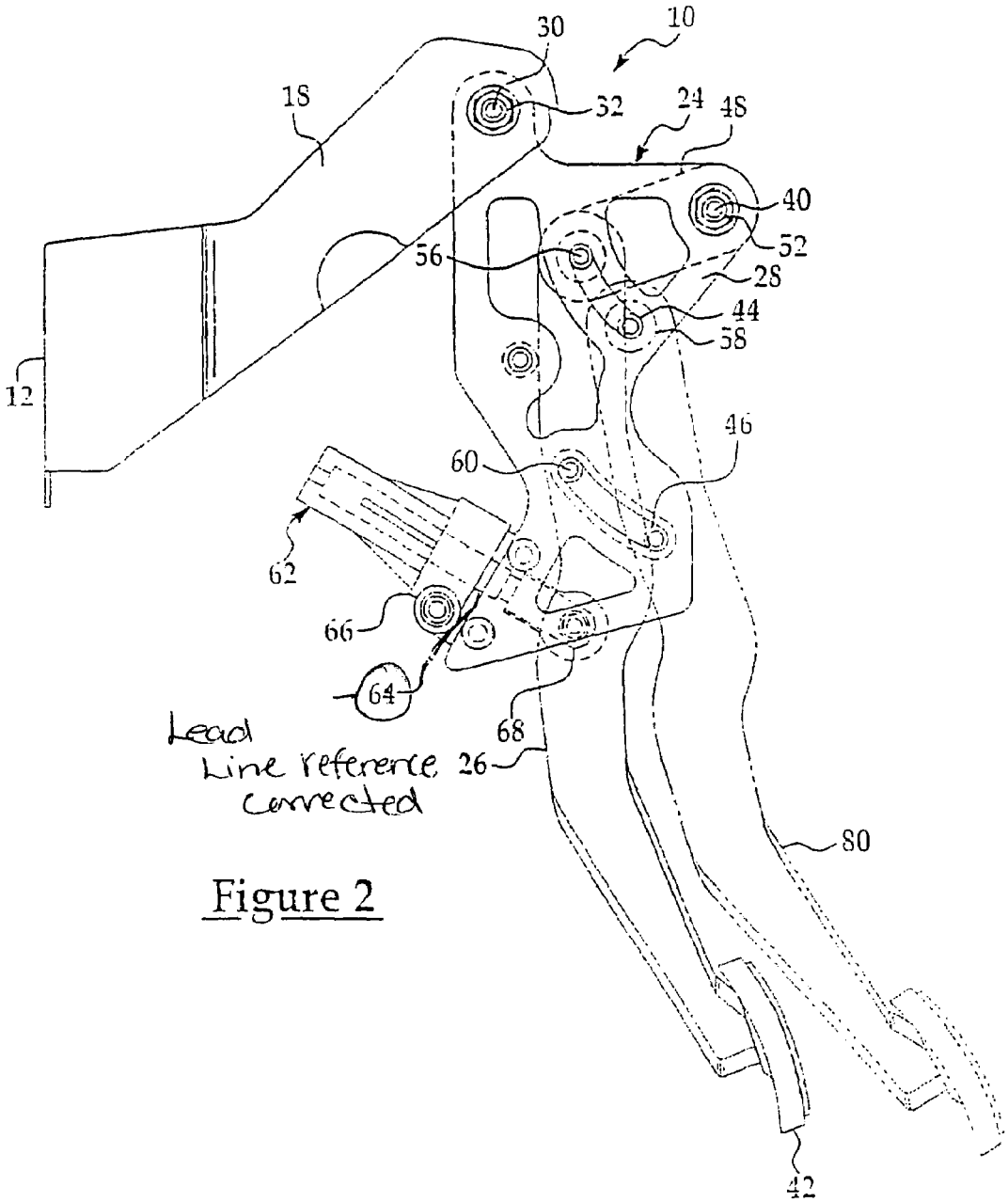
FIG. 2 is a side view of the adjustable brake pedal assembly of FIG. 1 showing the range of adjustment, according to the present invention.

Referring to FIGS. 1 and 2, an adjustable brake pedal assembly 10 for translating a signal between a vehicle operator or driver (not shown) and a brake actuating mechanism (not shown), as is known in the art for slowing down the vehicle, is illustrated. The brake pedal assembly 10 includes a support bracket 12 for attaching the brake pedal assembly 10 to a portion of the vehicle, such as the dash panel. In this example, the support bracket 12 includes a generally planar mounting surface 14 having apertures 16 for attaching the support bracket 12 to the vehicle, such as by bolting. The support bracket 12 includes a channel-shaped support arm 18 extending outwardly from the mounting surface 14. An outer end 20 of the support arm includes at least one, and preferably two apertures 22 for pivotally attaching an adjustment bracket 24, in a manner to be described.

The adjustment bracket 24 supports a pedal arm 26 and includes a pair of generally planar sides 28 that are spaced a predetermined distance apart. An upper end of each side 28 includes an upper aperture (not shown) for forming a pedal travel pivot point shown at 30. It should be appreciated that the brake pedal assembly 10 travels between a resting position and a fully extended position to operatively control a braking mechanism (not shown) for the vehicle. A pivot pin 32 is disposed within the support arm aperture 22 and adjustment bracket upper aperture, pivotally interconnecting the support bracket 12 and adjustment bracket 24, such that the adjustment bracket 24 pivots about the support bracket 12, which is fixed at the pedal travel pivot point 30. It should be appreciated that the end of the pivot pin 32 may include a fastener, such as a nut 36, for retaining the pivot pin 32. Preferably, the brake pedal assembly includes a torsion spring 34 operatively disposed on the pivot pin 32 for controlling the movement of the brake pedal assembly 10 between a resting and braking position, as is known in the art.

An outer end of each adjustment bracket side 28 includes an aperture 38 at a pedal pad pivot point shown at 40, for ergonomically adjusting the position of a pedal pad 42 relative to a portion of the vehicle such as the floor, or the driver, in a manner to be described. Each side 28 further includes a first slot 44 and a second slot 46 for adjusting the position of the pedal pad 42, in a manner to be described. In this example, the first slot 44 and second slot 46 have an arcuate shape. It should be appreciated that the first slot 44 and second slot 46 are positioned in a predetermined manner to control the relative position of the pedal pad 42 with respect to the pedal arm 26, in a manner to be described.

The pedal pad 42 is attached to a lower end of the pedal arm 26. In this example, the pedal arm 26 has an "L" shape and is generally planar; however, it is contemplated that the pedal arm 26 can be formed as a channel. The pedal pad 42 is a generally planar member that is rectangular. Preferably, the pedal pad 42 is made from an isomeric material, such as rubber. The pedal pad 42 is attached to the pedal arm 26 in a conventional manner, and can be stationary or articulate, as is known in the art.

The brake pedal assembly 10 includes a pair of generally planar joining members 48 spaced a predetermined distance apart for pivotally interconnecting the adjustment bracket 24 to the pedal arm 26. One end of the joining member includes an aperture 50 for pivotally attaching the adjustment bracket 24 at the pedal pad adjustment pivot point 40 using a conventional attaching mechanism, such as a pivot pin 52 passing through the aperture 38 in the side 28 and the aperture 50 in the one end of the joining member 48. In this example, the joining members are positioned between the attachment bracket sides 28.

Another end of each joining member 48 also includes an aperture 54, for pivotally attaching the pedal arm 26 to the adjustment bracket 24. An upper end of the pedal arm 26 includes an aperture 58 and is disposed in the space separating the joining members 48, and is pivotally attached to the other end of each joining member 48. For example, a pivot pin 56 is disposed in the aperture 54 in the other end of the joining member 48 and aperture 58 the upper end of the pedal arm 26. Preferably, the pivot pin 56 is of sufficient length to extend outwardly, and slidably fit within the first slot 44 in the side 28, to guide the travel of the pedal arm 26 as the position of the pedal pad 42 is adjusted. The pedal arm 26 further includes a perpendicularly extending second pin 60 which slidably fits within the second slot 46 in the side 28, to further guide the travel of the pedal arm 26 as the position of the pedal pad 42 is adjusted. Advantageously, the first and second slots 44, 46 with first and second pins 56, 60 slidably traveling therein, provides a redundancy to the adjustable brake pedal assembly 10.

The adjustable brake pedal assembly 10 also includes a pedal adjusting mechanism 62. In this example, the pedal adjusting mechanism includes a jack screw 64 and drive mechanism 66, which is mounted to the adjustment bracket 24. Preferably, the jack screw 64 is attached to the pedal arm, such as by a clevis 68. The jack screw 64 extends between the sides 28 of the adjustment bracket 24. An electric motor (not shown) is connected to a worm by a cable, as is known in the art.

In operation, actuation of the pedal adjusting mechanism 62 by the driver (not shown) induces a lead screw (not shown) to rotate and extend or return the jack screw 64 as shown in FIG. 2. The pins 56, 60 slidably move within the arcuate slots 44, 46 in the sides 28 of the adjustment bracket 24, to guide the pedal arm 26 and joining members 48 during adjustment. As the pedal arm 26 is adjusted, the pedal pad 42 is ergonomically positioned for the driver as shown at 80.

It should be appreciated that the adjustable brake pedal assembly 10 may include other component parts, such as switches (not shown), which are conventional and known in the art for the adjustable brake pedal assembly 10.

Figure 3:
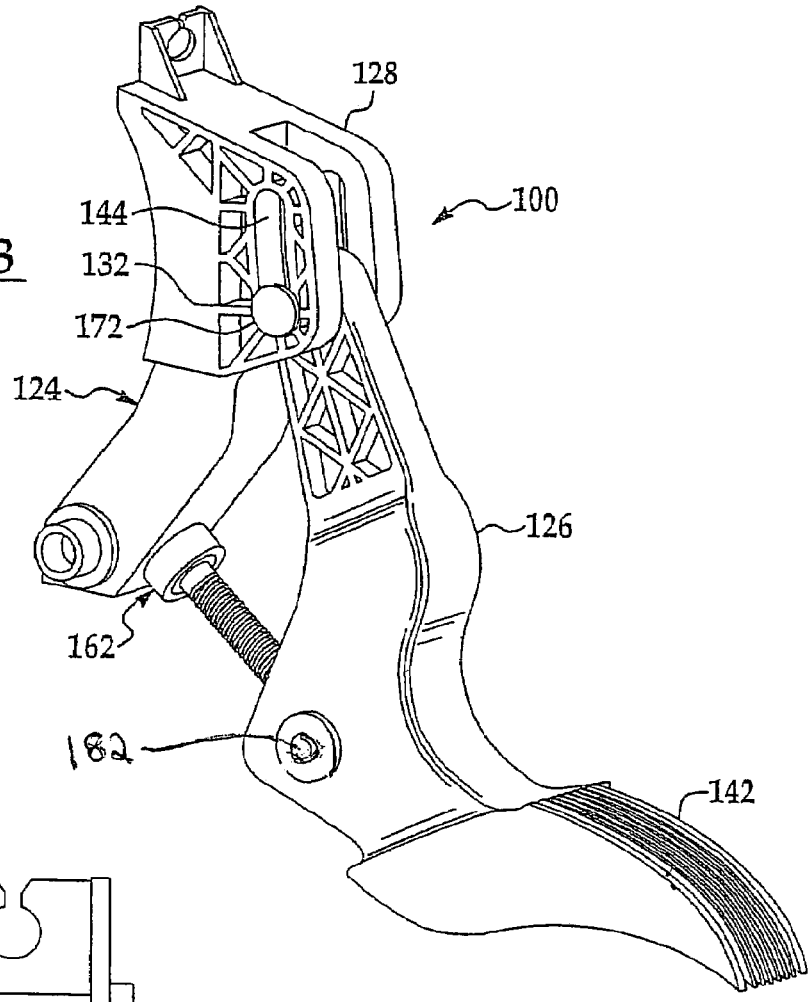
FIG. 3 is a perspective view of an adjustable pedal assembly for accelerating, according to the present invention.
Figure 5:
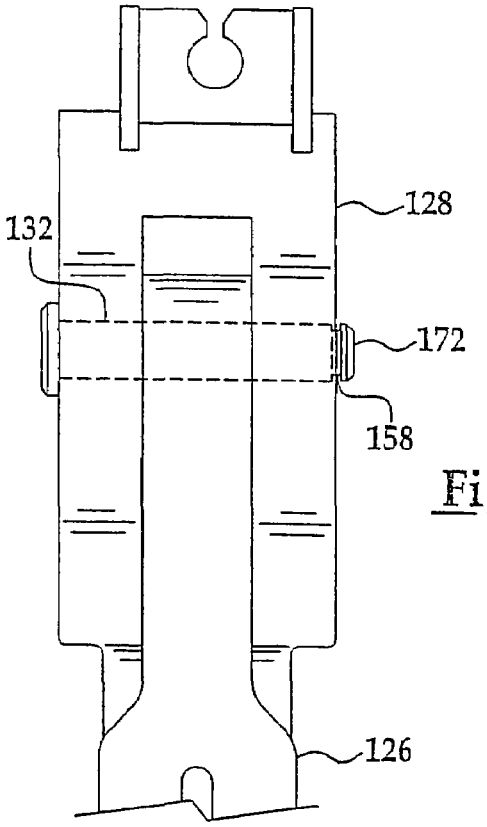
FIG. 5 is a front view of the adjustable accelerator pedal assembly of FIG. 3, according to the present invention.
Figure 4:
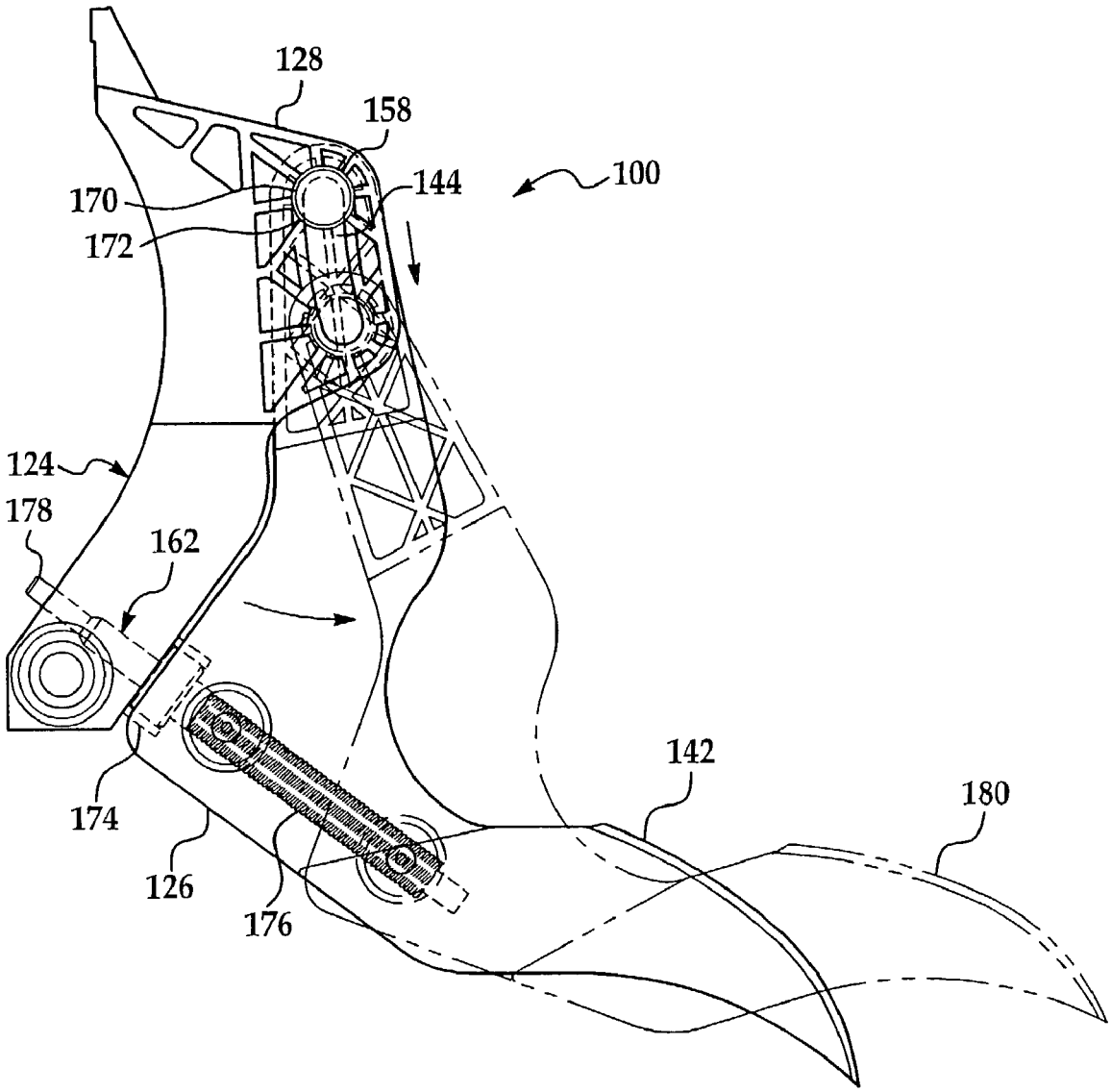
FIG. 4 is a side view of the adjustable accelerator pedal assembly of FIG. 3 showing the range of adjustment, according to the present invention.
Figure 2:
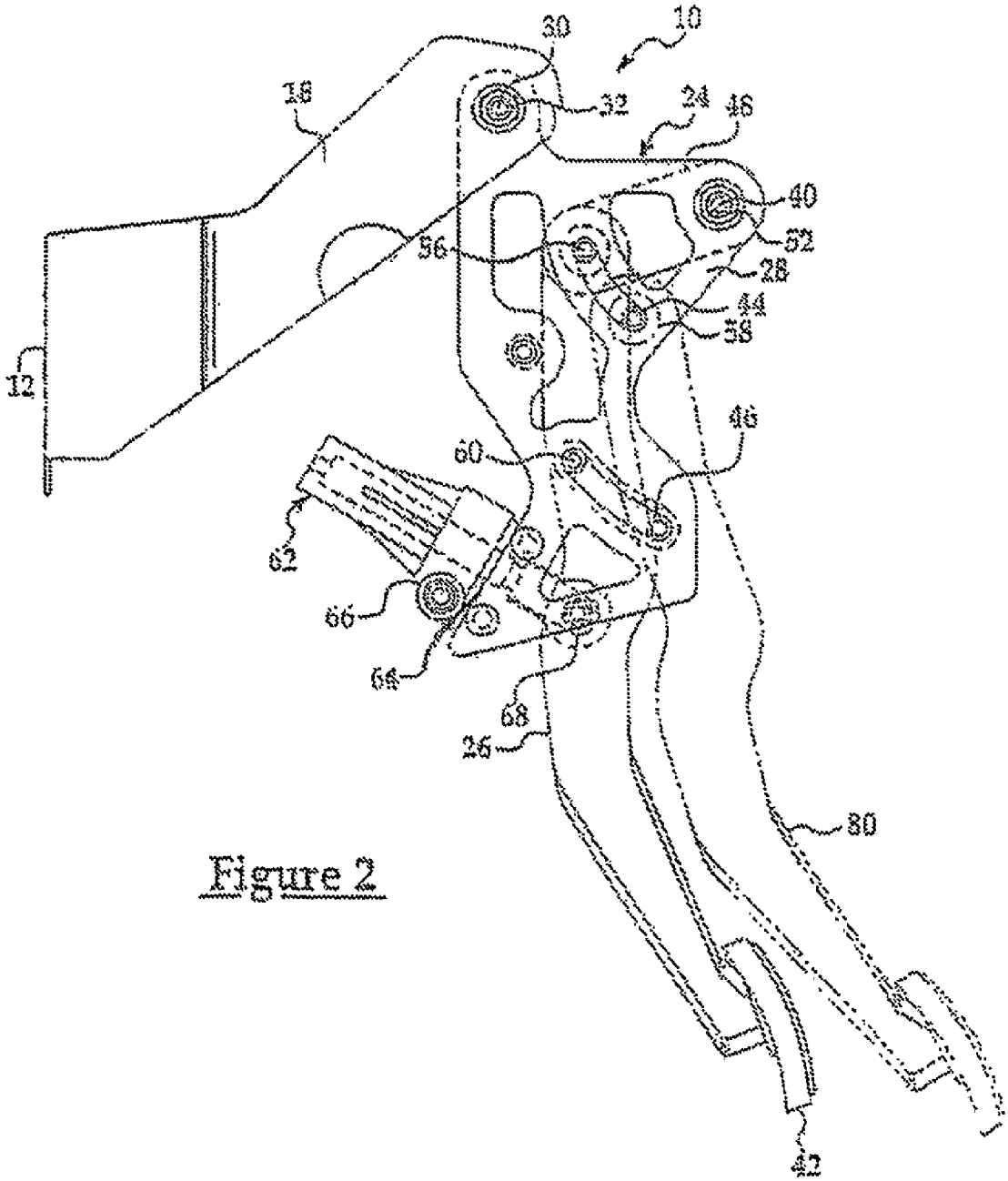

Referring to FIGS. 3–5, the adjustable accelerator pedal assembly 100 is illustrated. It should be appreciated that the adjustable accelerator pedal assembly 100 is similar to the adjustable brake pedal assembly 10, and like numerals increased by one hundred are utilized to indicate like components.

The accelerator pedal assembly 100 includes a support bracket (not shown) for attaching the accelerator pedal assembly 100 to a portion of the vehicle (not shown), such as the dash panel in a conventional manner. The accelerator pedal assembly 100 includes an adjustment bracket 124 for supporting a pedal arm 126. The adjustment bracket 124 is a channel shaped member, generally having a backwards "C" shape. An upper end of the adjustment bracket includes a pair of outwardly extending side portions 128 spaced a predetermined distance apart. Each side portion 128 includes a vertically extending arcuate slot 144, for a purpose to be described.

The accelerator pedal assembly 100 includes a pedal arm 126, with a pedal pad 142 attached to the pedal arm 126. In this example, the pedal arm 126 has an "L" shape and is formed as a channel. The pedal pad 142 is a generally planar member that is rectangular. Preferably, the pedal pad 142 is made from an isomeric material, such as rubber. The pedal pad 142 is attached to the pedal arm 126 in a conventional manner, and can be stationary or articulate, as is known in the art. An upper end of the pedal arm 126 includes an aperture 158 for pivotally attaching the pedal arm 126 to the adjustment bracket 124, in a manner to be described. In this example, the pedal arm 126 is positioned between the sides 128 of the adjustment bracket 124.

The adjustable accelerator pedal assembly 100 includes a pivot pin 170 for attaching the pedal arm 126 to the adjustment bracket 124. The pin 170 is of sufficient length, so that an end of the pin 170 extends therethrough the slot 144 in the adjustment bracket 124 and the aperture 158 in the pedal arm 126, to slidably attach the pedal arm 126 to the adjustment bracket 124. Preferably, the end of the pivot pin is elongated as shown at 172, so that the pin 170 is slidably retained in the arcuate slot 144 of the adjustment bracket 124. Advantageously, the slidable motion of the pin 170 within the arcuate slot 144 guides the travel of the pedal arm 126 in ergonomically adjusting the position of the pedal pad 142.

The adjustable accelerator pedal assembly 100 also includes a pedal adjusting mechanism 162. For example, the pedal adjusting mechanism 162 includes a cylindrical worm 174 that drives a gear (not shown) mounted on a lead screw 176, as is known in the art. The worm 174 is mounted to a lower end of the adjustment bracket 124. The worm 174 is turned by a motor (not shown) which is mounted in a remote location and connected to the center of the worm gear 174 by a cable 178. The screw end extends outwardly to the lead screw 176 supporting a trunion (not shown), to which a mid-portion of the pedal arm 126 is pivotally connected, as shown at 182. Energization of the motor drives the cable 178 to turn the worm 174 and worm gear to move the lead screw 176 with the trunion. As the trunion moves outwardly on the lead screw 176, the pedal arm 126 is moved away from the adjustment bracket 124 and the pin 170 slides downwardly in the arcuate slot 144 to move the pedal pad 142 rearwardly into the vehicle and upwardly from the floor as shown at 180 in FIG. 4. The pedal arm 126 is free to rotate about the trunion attached to the lead screw 176 as the pedal arm 126 is adjusted.

Advantageously, the curvature of the slot 144 in the adjustment bracket 124 is determined in combination with the attachment of the pedal pad 142 and pedal pad length, to permit repositioning of the pedal pad 142 at a predetermined angle with respect to the floor, after the position of the pedal arm 126 has been adjusted. The center of the radius of curvature is positioned rearwardly of the adjustment bracket 124 and above the pedal arm 126 and surface. It should be appreciated that in this example, the pedal pad 142 has an elongated curved shape. Advantageously, the angle of the foot in contacting the pedal pad 142 is ergonomically maintained while the height of the pedal pad 142 with respect to the floor of the vehicle is adjusted to a comfortable position for the driver.

It should be appreciated that the adjustable accelerator pedal assembly 100 may include other component parts, such as switches (not shown), which are conventional and known in the art for the adjustable accelerator pedal assembly.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

The invention claimed is:

1. An adjustable pedal assembly for a vehicle comprising:

a support bracket for attaching the pedal assembly to the vehicle;

a vertically extending adjustment bracket pivotally mounted to said support bracket at a fixed, stationary pivot point, wherein an upper end of the adjustment bracket includes a pair of outwardly extending side portions, with each side portion having one generally vertically extending arcuate slot;

a one piece pedal arm, wherein an upper end of said pedal arm is pivotally attached to said adjustment bracket at a single attachment point using one pivot pin, such that each end of said pivot pin is slidably disposed within the corresponding one vertically extending arcuate slot in each side portion of said adjustment bracket to adjustably position said pedal arm relative to said adjustment bracket along a vertically oriented arcuate line;

a pedal pad mounted to a lower end of said pedal arm; and a pedal adjustment mechanism fixedly attached to a mid-portion of said pedal arm, for adjusting the position of said pedal arm relative to said adjustment bracket by slidably positioning said pivot pin in the corresponding one vertically extending arcuate slot in each side portion to ergonomically position the pedal pad.

2. A pedal assembly as set forth in claim 1 wherein the support bracket includes a mounting surface and a support arm extending from the mounting surface.

3. A pedal assembly as set forth in claim 1, wherein said adjustment bracket is a channel-shaped member and each of said side portions extend outwardly from an upper portion of said adjustment bracket.

4. A pedal assembly as set forth in claim 3, wherein an end of said pivot pin is elongated so that the pedal arm is slidably supported in the arcuate slot.

5. The pedal assembly of claim 1, wherein said pedal adjusting mechanism includes a screw member and a drive mechanism, one end of said screw member is pivotally connected to said pedal arm.

6. An adjustable accelerator pedal assembly for a vehicle for ergonomically adjusting the position of the accelerator pedal assembly relative to an operator of the vehicle comprising:

a vertically extending adjustment bracket adapted for pivotal mounting on a vehicle at a fixed, stationary pivot point, wherein an upper end of the adjustment bracket includes a pair of outwardly extending side portions, with each side portion having one generally vertically extending arcuate slot;

a one piece pedal arm disposed between each side portion of said adjustment bracket, wherein an upper end of said pedal arm is pivotally attached to said adjustment bracket at a single attachment point using one pivot pin, such that each end of said pivot pin is slidably supported in the corresponding one vertically extending arcuate slot in each side portion of said adjustment bracket to adjustably position said pedal arm relative to said adjustment bracket along a vertically oriented arcuate line;

a pedal pad mounted to a lower end of said pedal arm; and an accelerator pedal adjustment mechanism fixedly attached to a mid-portion of said pedal arm, for adjusting the position of said pedal arm relative to said adjustment bracket by slidably positioning said pivot pin in the corresponding one vertically extending arcuate slot in each side portion to ergonomically position the pedal pad.

7. An accelerator pedal assembly as set forth in claim 6, wherein said adjustment bracket is a vertically oriented channel-shaped member and each of said side portions extend outwardly from an upper portion of said adjustment bracket.

8. An accelerator pedal assembly as set forth in claim 6, wherein said pedal adjusting mechanism includes a screw member and a drive mechanism, and one end of said screw member is pivotally connected to said pedal arm.

9. An adjustable accelerator pedal assembly for a vehicle for ergonomically adjusting the position of the accelerator pedal assembly relative to an operator of the vehicle comprising:

a vertically oriented adjustment bracket wherein a lower end of said adjustment bracket is adapted for pivotal mounting on a vehicle at a fixed, stationary pivot point, and an upper end of said adjustment bracket includes a pair of outwardly extending side portions and each side portion includes one generally vertically extending arcuate slot;

a one piece pedal arm, wherein an upper end of said pedal arm is pivotally attached to said adjustment bracket at a single attachment point using one pivot pin, such that each end of said pivot pin is slidably supported in the corresponding one arcuate slot in each side portion of said adjustment bracket to adjustably position said pedal arm relative to said adjustment bracket along a vertically oriented arcuate line;

a pedal pad mounted to a lower end of said pedal arm; and an accelerator pedal adjustment mechanism fixedly connected to a mid-portion of said pedal arm for adjusting the position of said pedal arm relative to said adjustment bracket, wherein said pedal adjusting mechanism includes a screw member and a drive mechanism, and one end of said screw member is pivotally connected to the mid-portion of said pedal arm, and said pedal adjusting mechanism slidably positions said pivot pin in the one arcuate slot relative to the vertically oriented arcuate movement of the pedal arm, to ergonomically position the pedal pad.

* * * * *

UNITED STATES PATENT AND TRADEMARK OFFICE

CERTIFICATE OF CORRECTION

PATENT NO. : 7,051,613 B2
APPLICATION NO. : 10/447127
DATED : May 30, 2006
INVENTOR(S) : Burton et al.

It is certified that error appears in the above-identified patent and that said Letters Patent is hereby corrected as shown below:

Please delete Fig. 2 and replace with Fig. 2 on attached revised drawing sheet.

Signed and Sealed this

Seventeenth Day of July, 2007

JON W. DUDAS
*Director of the United States Patent and Trademark Office*